US010408450B2

(12) United States Patent
Falkenhayn

(10) Patent No.: US 10,408,450 B2
(45) Date of Patent: Sep. 10, 2019

(54) FLINT FIRE STARTER

(71) Applicant: EXOTAC, INC., Winder, GA (US)

(72) Inventor: Rob Falkenhayn, Hoschton, GA (US)

(73) Assignee: Exotac, Inc., Winder, GA (US)

( * ) Notice: Subject to any disclaimer, the term of this patent is extended or adjusted under 35 U.S.C. 154(b) by 49 days.

(21) Appl. No.: 15/664,269

(22) Filed: Jul. 31, 2017

(65) Prior Publication Data

US 2018/0031234 A1 Feb. 1, 2018

Related U.S. Application Data

(60) Provisional application No. 62/369,242, filed on Aug. 1, 2016.

(51) Int. Cl.
*F23Q 1/06* (2006.01)
*C10L 11/04* (2006.01)
*F23Q 2/48* (2006.01)

(52) U.S. Cl.
CPC ..... *F23Q 1/06* (2013.01); *C10L 11/04* (2013.01); *F23Q 2/48* (2013.01)

(58) Field of Classification Search
CPC ..... F23Q 1/06; F23Q 2/48
USPC ..... 431/136–141; 44/506, 507
See application file for complete search history.

(56) References Cited

U.S. PATENT DOCUMENTS 2,527,100 A * 10/1950 Lohr ..... F23Q 2/06 431/142
2,541,111 A * 2/1951 Simon ..... F23Q 2/06 431/140
2,780,085 A * 2/1957 Perlin ..... F23Q 2/162 431/142
3,650,660 A * 3/1972 Huguet ..... F23Q 1/02 431/191
3,994,666 A * 11/1976 Spinosa ..... F23Q 1/06 431/144
4,351,318 A * 9/1982 Ojima ..... F23Q 2/32 126/208
5,800,022 A * 9/1998 Del Rosario ..... A63C 17/06 280/11.221
2009/0214996 A1* 8/2009 Putrello ..... F23Q 1/06 431/273

* cited by examiner

*Primary Examiner* — Avinash A Savani
*Assistant Examiner* — Rabeeul I Zuberi
(74) *Attorney, Agent, or Firm* — Eversheds Sutherland (US) LLP

(57) ABSTRACT

A fire starter may include a fire starting mechanism comprising a friction wheel, an axle, a flint, a spring, and a screw. The fire starter also may include a housing and a capsule with a storage compartment therein. The capsule may be attachable to the main housing. The axle may pass through the friction wheel and be screwed or pressed into the housing. Ignition may be created by the spring pressing the flint into the friction wheel, with the screw holding the spring and flint in place such that when the friction wheel is rotated, a spark is generated. The friction wheel may be attached to the housing by the axle at to a single connection point, and the housing may be attached to a tinder removal device, which may be positionable within the storage compartment of the capsule when the housing and the capsule are attached together.

20 Claims, 6 Drawing Sheets

FLINT FIRE STARTER

CROSS-REFERENCE TO RELATED APPLICATIONS

The disclosure claims priority to and the benefit of U.S. provisional patent application No. 62/369,242, filed Aug. 1, 2016, which is incorporated herein by reference in its entirety.

FIELD OF THE DISCLOSURE

The disclosure generally relates to flint fire starters and more particularly relates to one handed flint fire starters.

BACKGROUND

Flint fire starters are often carried as a backup method of starting a fire when traveling outdoors in the event a primary means of starting a fire is lost, breaks, or becomes unusable. Methods that require one hand for operation are especially useful as they can still be used in case of an injury to a hand or arm. Flint fire starters of this style are typically very basic and use an ignition method commonly used in lighters, where a spring presses a flint against a friction wheel, which causes a spark when the wheel is rotated. Because these devices are very simple, they do not allow for storage that might hold tinder or replacement flints.

It is also common for fire starters to have a construction that includes a main body with a slot through the top for the friction wheel to sit. A pin then passes through both sides of the slot and through the flint wheel so that the friction wheel is supported on both sides and can freely rotate. This allows for easy and secure attachment but can make it hard to get the spark as close to the tinder as possible.

SUMMARY

Some or all of the above needs and/or problems may be addressed by certain embodiments of the flint fire starter disclosed herein. A flint fire starter comprises a fire starting mechanism comprising a friction wheel, an axle, a flint, a spring, and a thumb screw. The flint fire starter also includes a housing which holds the fire starting mechanism and a capsule with a storage compartment therein. The capsule is attachable to the main housing. The axle passes through the friction wheel and is screwed or pressed into the housing. Ignition is created by the spring pressing the flint into the friction wheel with the set screw holding the spring and flint in place such that when the friction wheel is spun, a spark is generated.

Other features and aspects of the disclosure will be apparent or will become apparent to one with skill in the art upon examination of the following figures and the detailed description. All other features and aspects, as well as other system, method, and assembly embodiments, are intended to be included within the description and are intended to be within the scope of the accompanying claims.

BRIEF DESCRIPTION OF THE DRAWINGS

The detailed description is set forth with reference to the accompanying drawings. The use of the same reference numerals may indicate similar or identical items. Various embodiments may utilize elements and/or components other than those illustrated in the drawings, and some elements and/or components may not be present in various embodiments. Elements and/or components in the figures are not necessarily drawn to scale. Throughout this disclosure, depending on the context, singular and plural terminology may be used interchangeably.

DETAILED DESCRIPTION

Figure 1:
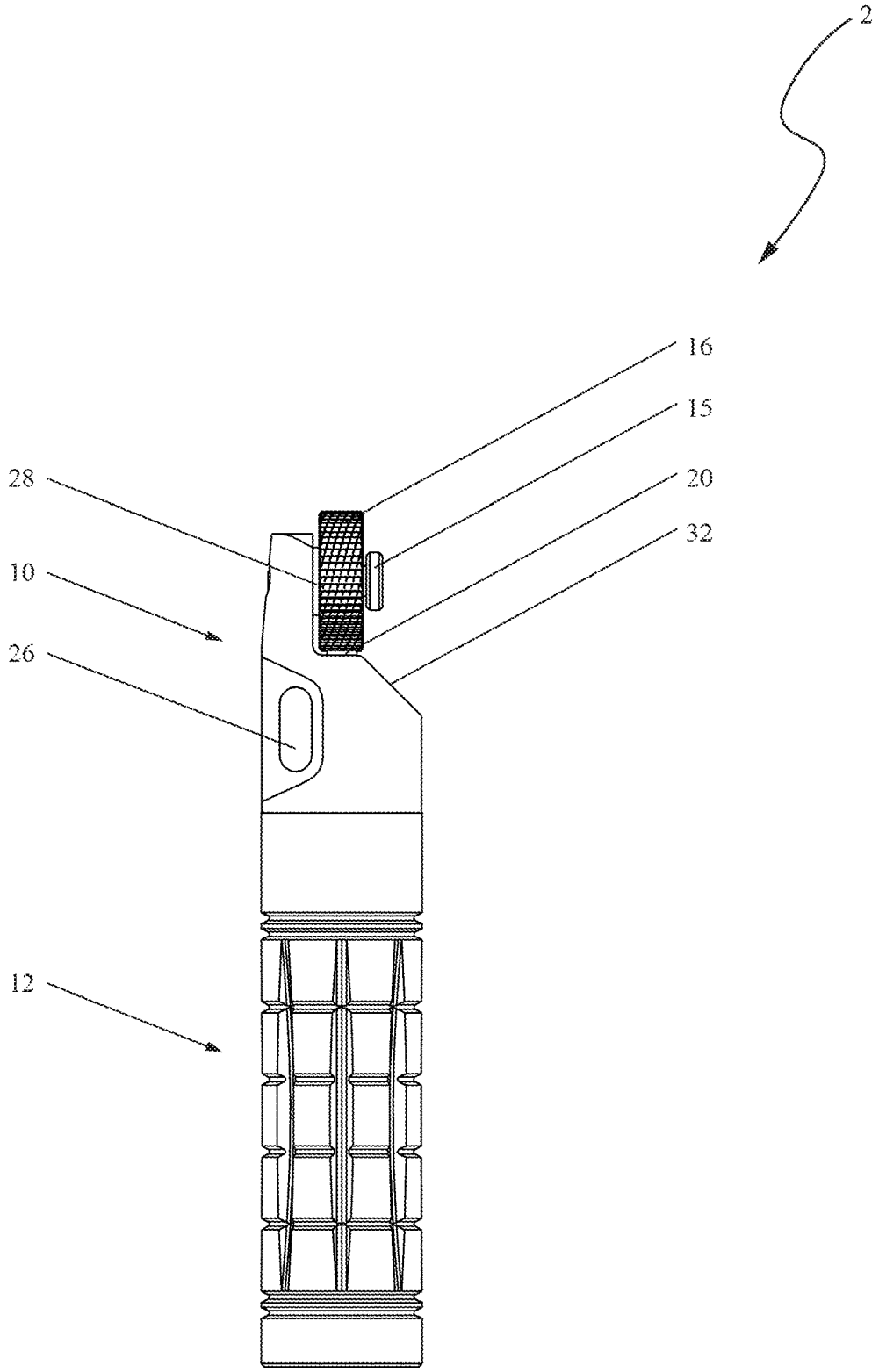
FIG. 1 depicts a front view of a flint fire starter in accordance with one or more embodiments of the disclosure.
Figure 2:
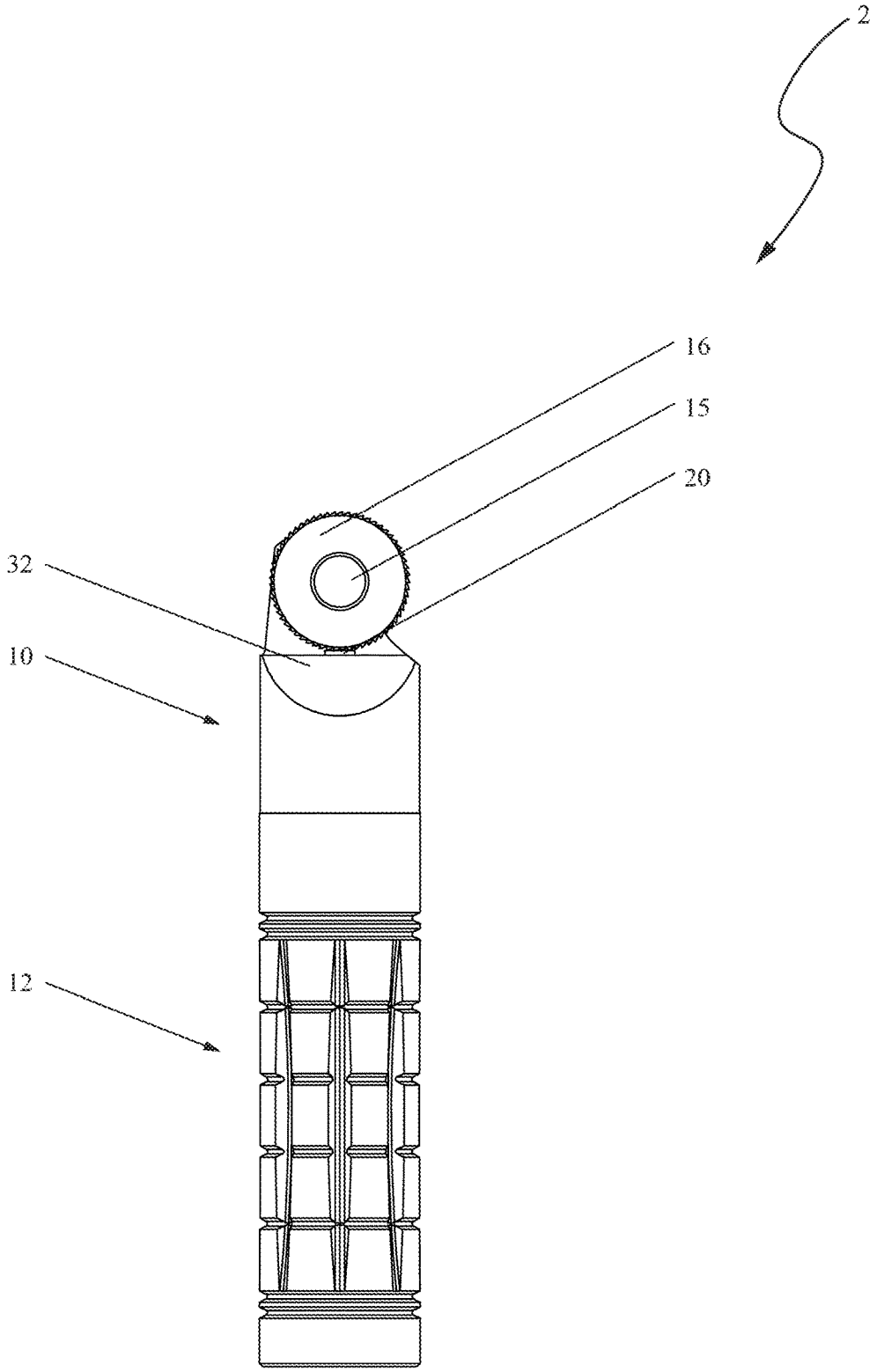
FIG. 2 depicts a right side view of a flint fire starter in accordance with one or more embodiments of the disclosure.

The present disclosure is directed to a fire starter that incorporates a waterproof capsule. In some instances, the fire starter may be a flint fire starter that is operable with one hand. The fire starter may include a housing, which may hold a fire starting mechanism. The fire starting mechanism may comprise a friction wheel, an axle, a flint, a spring, and a screw. The axle may pass through the friction wheel and may be screwed or pressed into the housing, which may enable the friction wheel to spin freely. The diameter of an axle head may be larger than a hole in the friction wheel, which may keep the friction wheel from falling off of the axial. In addition, the diameter of the axle head may be smaller than the total outside diameter of the friction wheel, which may result in an open design that allows the user to place the tinder very near the ignition source for easier and more consistent lighting. Ignition may be created by the spring pressing the flint into the friction wheel, with the screw holding the spring and flint in place. When the friction wheel is spun, a spark may be generated.

The housing may include an O-ring disposed in a groove located just above the threads in the housing in which the capsule may be attached. The capsule can be screwed on/off of the housing as needed. The capsule may act as a handle to extend the gripping surface needed for using the device. When fully assembled, the housing and capsule may form a single secure assembly that can hold replacement flints in addition to fire starting tinder while also functioning as a fire starter. The flint may be easily changed by removing the top assembly and unscrewing the thumb screw, which may give the user access to the flint and spring for replacement and maintenance. Likewise, the tinder may be disposed in a cavity of the capsule and readily accessed by removal of the housing, which may include a tinder removal device attached thereto via the screw.

The fire starter described herein includes a storage cavity, which is an improvement over a typical fire starter, while maintaining functionality and keeping manufacturing costs low. In addition, fire starter described herein includes only a single support from one side, which is made possible by a threaded or press-in axle. This opens up the area where the spark originates allowing the user to get the tinder closer to where the spark is made, which is an improvement over a typical fire starter, resulting in more consistent ignition of tinder and a higher success rate.

FIGS. 1-4 depict a fire starter 2. In some instances, the fire starter 2 may be a flint fire starter. The fire starter 2 may include, among other things, a housing 10 and a capsule 12. The housing 10 may be configured to hold a fire starting mechanism, which is described in greater detail below. In certain embodiments, the housing 10 may include an internal cavity which houses at least a portion of the fire starting mechanism. In some instances, the housing 10 may act as a cap for the capsule 12. That is, the housing 10 may be attached to the capsule 12. In some instances, the housing 10 and the capsule 12 may include corresponding threads for screwing the housing 10 to the capsule 12. The capsule 12 may include an internal cavity 19 (e.g., a storage compartment) that can be used to store tinder or other suitable materials therein. The housing 10 and the capsule 12 may be any suitable size, shape, or configuration. In some instances, the capsule 12 may include a textured outer surface to enhance a gripping surface of the fire starter 2.

In certain embodiments, a water tight seal may be created between the capsule 12 and housing 10. For example, an O-ring 24 may be disposed within a groove 9 about the housing 10. In this manner, the O-ring 24 may be compressed when the capsule 12 is attached (e.g., screwed) onto the housing 10, which may result in a water tight seal between the housing 10 and the capsule 12. More so, when the capsule 12 is attached to the housing 10, the capsule 12 may act as a handle to increase the area that can be held by a user.

In certain embodiments, a water tight seal may be created between the thumb screw 18 and housing 10. For example, an O-ring 32 may be disposed within a groove 34 about the housing 10. In this manner, the O-ring 32 may be compressed when the thumbscrew 18 is attached (e.g., screwed) onto the housing 10, which may result in a water tight seal between the housing 10 and the thumbscrew 18.

FIG. 1 depicts a lanyard attachment hole 26 that can be used to attach a lanyard or keychain to the fire starter 2. In some instances, the lanyard attachment hole 26 may be integrally formed with the housing 10. In other instances, the lanyard attachment hole 26 may be integrally formed on the capsule 12. The lanyard attachment hole 26 may be located at any location on the fire starter 2 and may be any suitable size, shape, or configuration.

The housing 10 may include an attachment protrusion 11 extending therefrom. An axle 14 may be attached to the attachment protrusion 11. For example, one end of the axle 14 may be disposed within a hole 13 in the attachment protrusion 11. The axle 14 may be used to hold a friction wheel 16 and thrust washer 28 in place. In some instances, the thrust washer 28 may be disposed about the axle 14 between the attachment protrusion 11 and the friction wheel 16. The friction wheel 16 may freely rotate about the axle 14. In certain embodiments, the axle 14 may include a head end 15. In some instances, a diameter of the head end 15 may be larger than a hole 17 in the friction wheel 16 but smaller than an outer diameter of the friction wheel 16. In this manner, the head end 15 may be configured to maintain the friction wheel 16 about the axle 14. As a result, the friction wheel 16 may be attached to the housing 10 via a single connection point (e.g., hole 13), which provides an open design allowing a user to place the tinder very near the ignition source for easier and more consistent lighting. To further facilitate the open design that enables a user to place the tinder very near the ignition source for easier and more consistent lighting, the side of the housing 10 opposite the attachment protrusion 11 may include a tapered surface 32. The tapered surface 32 may taper away from the friction wheel 16 to further expose the flint 20 and friction wheel 16 to the ignition source.

Figure 4:
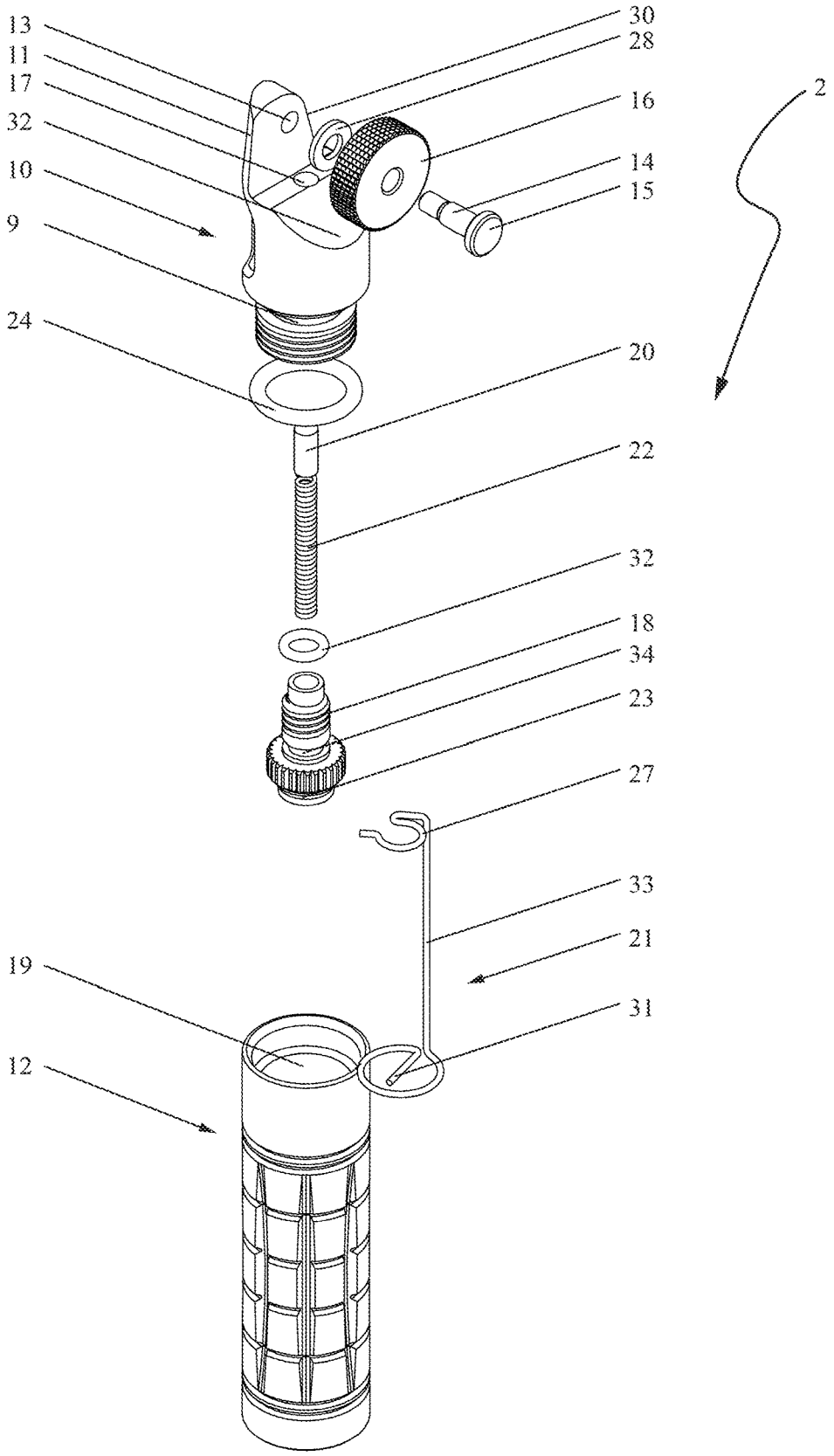
FIG. 4 depicts a top perspective exploded view of a flint fire starter in accordance with one or more embodiments of the disclosure.

As depicted in FIG. 4, a screw 18 may be screwed into a bottom of the housing 10. The screw 18 may be configured to maintain a flint 20 and a spring 22 within and internal cavity of the housing 10. For example, the spring 22 and the flint 20 may be at least partially disposed within a cavity 17 in the housing 10 adjacent to the friction wheel 16. The spring 22 may be disposed at least partially around and/or below the flint 20. For example, the spring 22 may be disposed at least partially around and/or beneath the flint 20 in the cavity 17 so as to exert a force upon the flint 20. In this manner, the flint 20 may be pushed up by the spring 22, which may cause the flint 20 to engage the friction wheel 16. The flint 20 and spring 22 may be captured between the screw 18, the cavity 17, and the friction wheel 16. Rotation of the friction wheel 16 may cause sparks between the friction wheel 16 and the flint 20.

Figure 3:
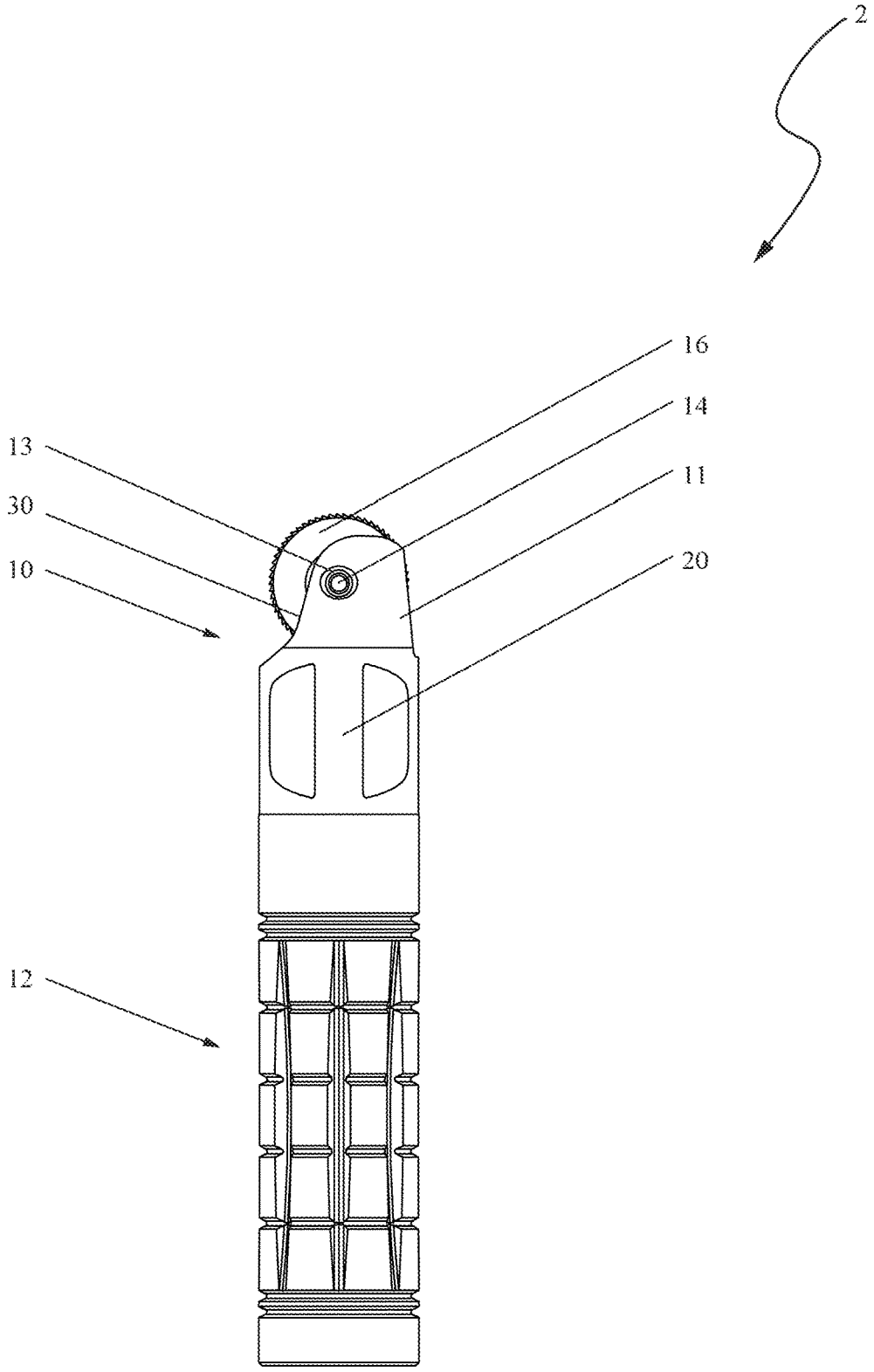
FIG. 3 depicts a left side view of a flint fire starter in accordance with one or more embodiments of the disclosure.

As depicted in FIG. 3, the attachment protrusion 11 may include a cutaway portion 30. The cutaway portion may be configured to expose only one side of the friction wheel 16. In this manner, a side profile of the attachment protrusion 11 may be asymmetrical. The cutaway portion 30 may prevent the friction wheel 16 from being rotated backwards, thereby causing user confusion. That is, only a portion of the outside or perimeter of the friction wheel 16 may be exposed for engagement with a user's thumb. For example, with reference to FIG. 3, the cutaway portion 30 may ensure that the left side of the friction wheel 16 is exposed. Conversely, the right side of the attachment protrusion 11 may extend to the perimeter of the friction wheel 16, thereby at least partially blocking the right side of the friction wheel 16. Due to the configuration of the attachment protrusion 11 and the cutaway portion 30, a user may intuitively know the correct way to rotate the friction wheel 16.

Figure 5:
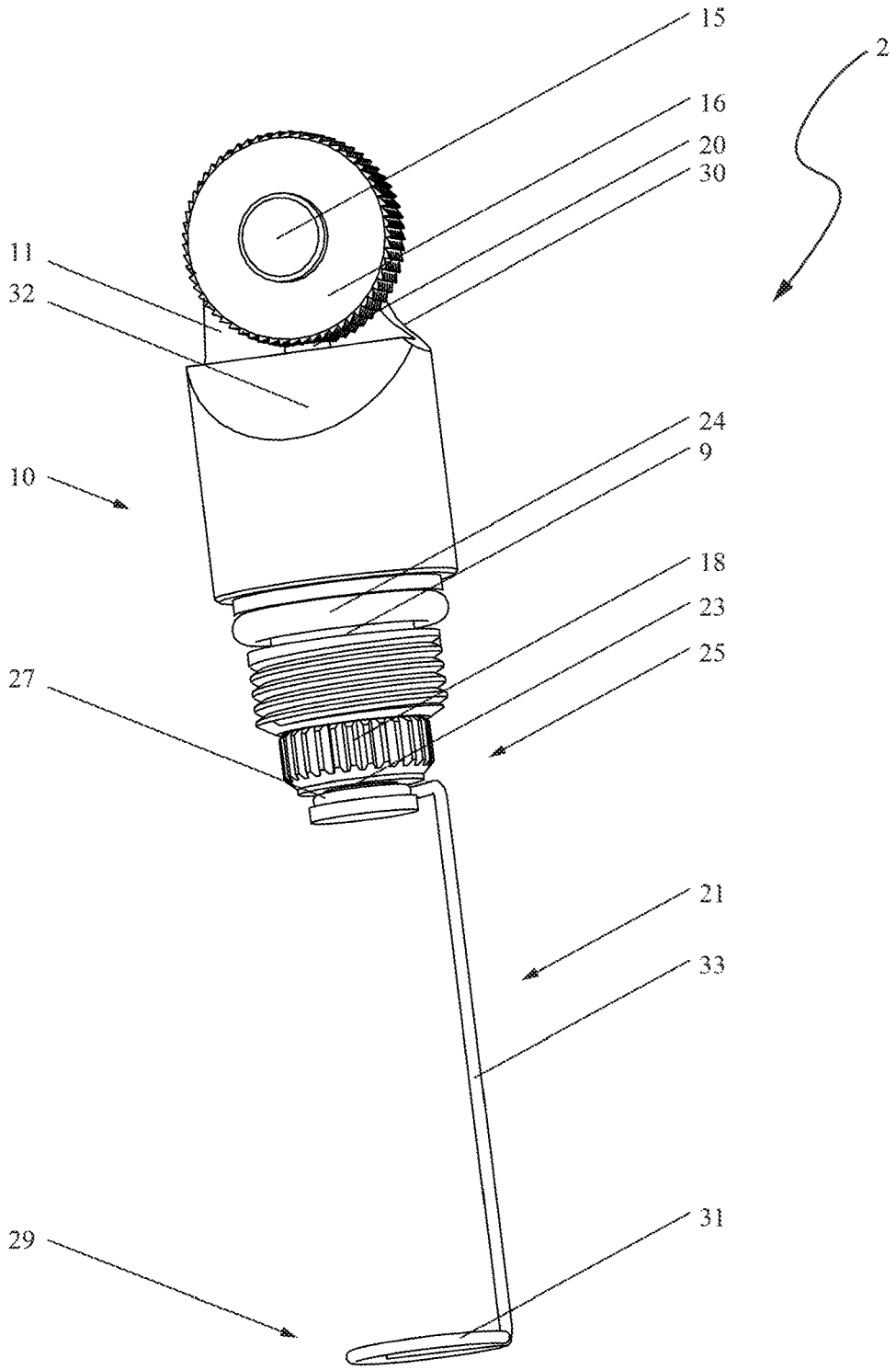
FIG. 5 depicts a top perspective view of a portion of a flint fire starter in accordance with one or more embodiments of the disclosure.
Figure 6:
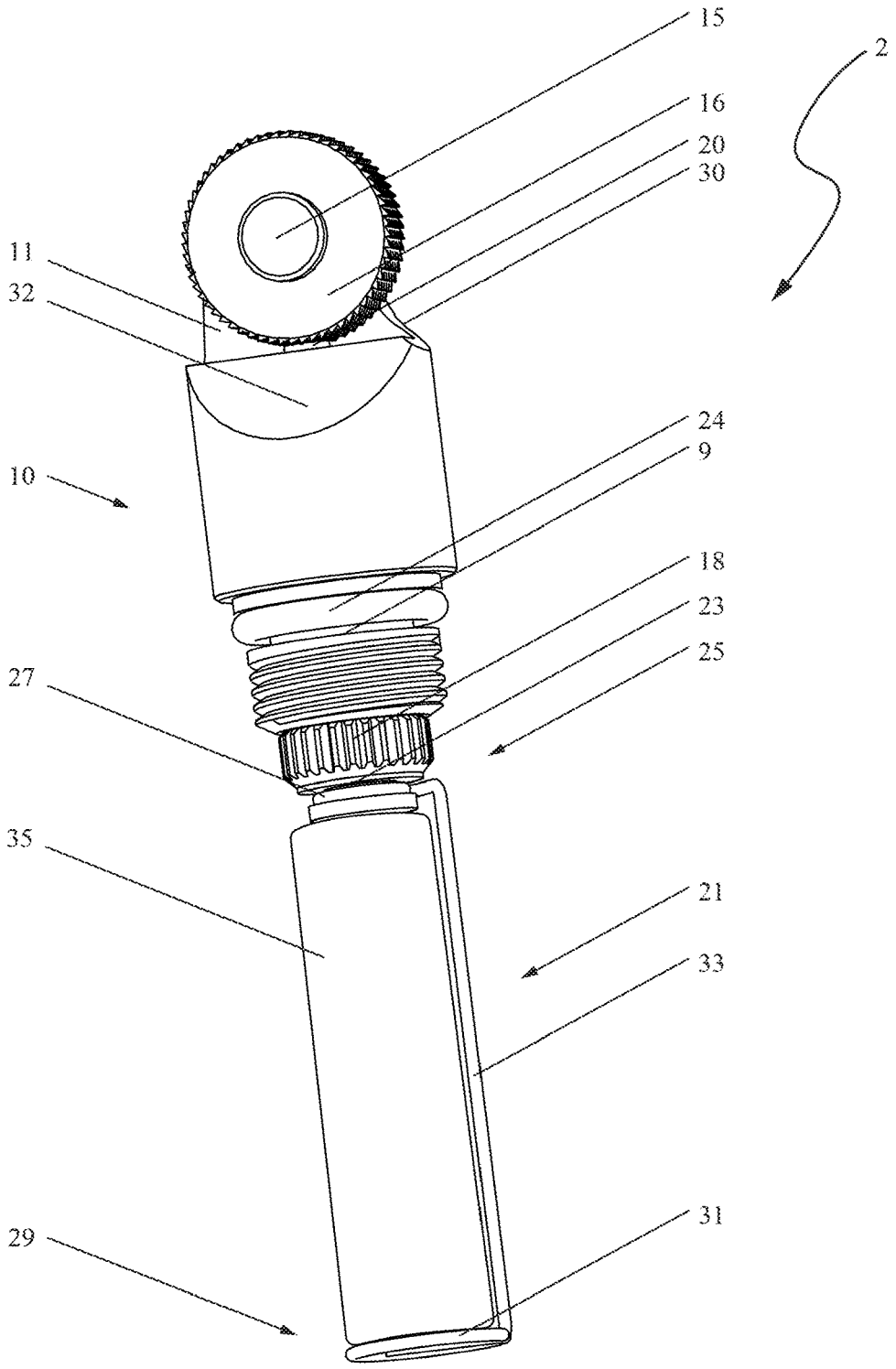
FIG. 6 depicts a top perspective view of a portion of a flint fire starter in accordance with one or more embodiments of the disclosure.

In certain embodiments, as depicted in FIGS. 5 and 6, a tinder removal device 21 may be attached to the screw 18. In some instances, the tinder removal device 21 may comprise a wireform. As explained below, the tinder removal device 21 may aid in the removal of tinder 35 from the cavity 19 in the capsule 12. For example, an end of the screw 18 opposite the threaded portion of the screw 18 that is configured to be threaded into the housing 10 may include a groove 23. Likewise, the tinder removal device 21 may include a first end 25 that is configured to be attached to the groove 23. In one example embodiment, the first end 25 of the tinder removal device 23 may include a clip configuration 27 that is configured to be securely clipped into the groove 23. The tinder removal device 21 also may include a second end 29 that is configured to form a base 31 or the like. The first end 25 and the second end 29 of the tinder removal device 21 may be attached via a central portion 33. As depicted in FIG. 6, the tinder 35 may be disposed between the first end 25 and the second end 29 of the tinder removal device 21. In this manner, as the housing 10 is detached (e.g., unscrewed) and pulled apart from the capsule 12, the base 31 of the tinder removal device 21 may abut and pull the tinder 35 disposed within the cavity 19 of the capsule 12. As a result, the tinder 35 may be easily removed from the cavity 19.

In certain embodiments, the housing 10, the capsule 12, the axle 14, and the screw 18 may be made of metal or other non-flammable, heat resistant, and durable materials. The O-rings 24 and 32 may be made of an elastic plastic material, which is resilient enough to create a seal when compressed between two hard bodies but durable enough for many uses.

The advantages of flint fire starter include, without limitation, the ability to carry a flint fire starter with an integral storage capsule that is water tight to prevent destruction or degradation of the materials or objects contained within. The fire starter also has the added benefit of a more open design, which allows a user to get the tinder closer to the origin of the spark. Additionally, the flint fire starter may prevent the user from rotating the friction wheel in the wrong direction, which may cause a malfunction. The flint fire starter is also attachable to a keychain or lanyard for easier and more secure transportation.

Although specific embodiments of the disclosure have been described, numerous other modifications and alternative embodiments are within the scope of the disclosure. For example, any of the functionality described with respect to a particular device or component may be performed by another device or component. Further, while specific device characteristics have been described, embodiments of the disclosure may relate to numerous other device characteristics. Further, although embodiments have been described in language specific to structural features and/or methodological acts, it is to be understood that the disclosure is not necessarily limited to the specific features or acts described. Rather, the specific features and acts are disclosed as illustrative forms of implementing the embodiments. Conditional language, such as, among others, "can," "could," "might," or "may," unless specifically stated otherwise, or otherwise understood within the context as used, is generally intended to convey that certain embodiments could include, while other embodiments may not include, certain features, elements, and/or steps. Thus, such conditional language is not generally intended to imply that features, elements, and/or steps are in any way required for one or more embodiments.

That which is claimed is:

1. A fire starter, comprising:

a fire starting mechanism;

a housing configured to hold the fire starting mechanism;

a screw configured to be attached to the housing and maintain at least a portion of the fire starting mechanism in engagement with the housing;

a capsule with a storage compartment therein, wherein the capsule is attachable to the housing such that an end of the screw is disposed within the storage compartment when the housing and capsule are attached together, wherein the storage compartment is configured to house tinder therein; and a tinder removal device attached to the end of the screw, wherein the tinder removal device is positionable within the storage compartment of the capsule when the housing and the capsule are attached together, wherein the tinder removal device is removable from the storage compartment to remove the tinder therein when the housing and capsule are detached from each other.

2. A fire starter, comprising:

a fire starting mechanism comprising a friction wheel, an axle, a flint, and a spring;

a housing configured to hold the fire starting mechanism, wherein the axle passes through the friction wheel and is attached to the housing, wherein the spring pressing the flint into the friction wheel such that when the friction wheel is spun, a spark is generated;

a screw attachable to the housing and configured to hold the spring and flint in place;

a capsule with a storage compartment therein, wherein the capsule is attachable to the housing such that an end of the screw is disposed within the storage compartment when the housing and capsule are attached together, wherein the storage compartment is configured to house tinder therein; and a tinder removal device attached to the end of the screw, wherein the tinder removal device is positionable within the storage compartment of the capsule when the housing and the capsule are attached together, wherein the tinder removal device is removable from the storage compartment to remove the tinder therein when the housing and capsule are detached from each other.

3. The fire starter of claim 2, wherein the flint is accessed by removing the capsule from the housing.

4. The fire starter of claim 2, further comprising a sealing element disposed between the housing and the capsule to form a waterproof seal between the housing and the capsule.

5. The fire starter of claim 2, wherein the flint is held in place by the spring and the screw that is hidden when the capsule is attached to the housing.

6. The fire starter of claim 2, wherein the friction wheel is attached to the housing by the axle at to a single connection point.

7. The fire starter of claim 6, wherein the axle comprises a head end opposite the single connection point.

8. The fire starter of claim 7, wherein a diameter of the axle head is larger than a hole in the friction wheel but smaller than a total outside diameter of the friction wheel.

9. The fire starter of claim 2, further comprising a lanyard or key ring attachment integrally formed with the housing.

10. The fire starter of claim 2, further comprising a cutout in the housing to expose a face of the friction wheel.

11. The fire starter of claim 2, further comprising an asymmetrical cutout on the housing to expose a portion of the friction wheel.

12. A fire starter, comprising:

a fire starting mechanism comprising a friction wheel, an axle, a flint, and a spring;

a housing configured to hold the fire starting mechanism, wherein the axle passes through the friction wheel and is attached to the housing, wherein the spring pressing the flint into the friction wheel such that when the friction wheel is spun, a spark is generated, wherein the friction wheel is attached to the housing by the axle at to a single connection point;

a screw attachable to the housing and configured to hold the spring and flint in place;

a capsule with a storage compartment therein, wherein the capsule is attachable to the housing such that an end of the screw is disposed within the storage compartment when the housing and capsule are attached together, wherein the storage compartment is configured to house tinder therein;

a tinder removal device attached to the end of the screw, wherein the tinder removal device is positionable within the storage compartment of the capsule when the housing and the capsule are attached together, wherein the tinder removal device is removable from the storage compartment to remove the tinder therein when the housing and capsule are detached from each other.

13. The fire starter of claim 12, further comprising a sealing element disposed between the housing and the capsule to form a waterproof seal between the housing and the capsule.

14. The fire starter of claim 12, wherein the axle comprises a head end opposite the single connection point.

15. The flint fire starter of claim 14, wherein a diameter of the axle head is larger than a hole in the friction wheel but smaller than a total outside diameter of the friction wheel.

16. The fire starter of claim 12, further comprising a lanyard or key ring attachment integrally formed with the housing.

17. The fire starter of claim 12, further comprising a cutout in the housing to expose a face of the friction wheel.

18. The fire starter of claim 12, further comprising an asymmetrical cutout on the housing to expose a portion of the friction wheel.

19. The fire starter of claim 1, wherein the end of the screw comprises a groove, and wherein the tinder removal device comprises a clip configured to be securely attached into the groove.

20. The fire starter of claim 19, wherein the tinder removal device comprises a wireform.

* * * * *